US005269908A

United States Patent [19]

Krupay

[11] Patent Number: 5,269,908

[45] Date of Patent: Dec. 14, 1993

[54] AMMONIUM CHLORIDE DEPOSIT RETARDATION IN HYDROCARBON STREAMS BY ADDITION OF INERT GAS

[75] Inventor: Bordan W. Krupay, Edmonton, Canada

[73] Assignee: Nalco Canada Inc.

[21] Appl. No.: 936,440

[22] Filed: Aug. 27, 1992

[51] Int. Cl.[5] ..... C10G 9/16; C23F 14/00

[52] U.S. Cl. ..... 208/254 R; 208/48 R; 208/95; 208/262.1; 203/7; 585/950

[58] Field of Search ..... 208/48 R, 48 AA, 95, 208/100, 254 R, 262.1, 302, 347, 356, 362; 203/6, 7; 585/950

[56] References Cited

U.S. PATENT DOCUMENTS

| | | | |
|---|---|---|---|
| 2,212,581 | 8/1940 | Babin | 208/48 R |
| 2,929,772 | 3/1960 | Gilmore | 208/99 |
| 4,098,675 | 7/1978 | Pope | 208/108 |
| 4,141,816 | 2/1979 | Crowley et al. | 208/107 |

*Primary Examiner*—Theodore Morris
*Assistant Examiner*—Walter D. Griffin
*Attorney, Agent, or Firm*—Bush, Moseley & Riddle

[57] ABSTRACT

In a process for the separation of hydrocarbon materials and other materials including ammonia and hydrogen chloride normally associated with the hydrocarbon materials in refining of petroleum, the deposition of ammonium chloride is retarded or prevented by introducing inert gas of higher volatility into the processing operation upstream from where the deposition of ammonium chloride would otherwise occur.

19 Claims, 1 Drawing Sheet

AMMONIUM CHLORIDE DEPOSIT RETARDATION IN HYDROCARBON STREAMS BY ADDITION OF INERT GAS

FIELD OF THE INVENTION

This invention relates to an improved method of processing hydrocarbon materials wherein the deposition of ammonium chloride typically encountered in such processing is reduced.

BACKGROUND OF THE INVENTION

In the refining of petroleum materials such as crude oil the oil or portions thereof is subjected to a number of processes, both physical and chemical, designed to improve the economic quality of the material. Such processes often include use of processing systems in which the temperature and/or pressure is varied. In one embodiment, distillation procedures are employed to separate the oil or components thereof into fractions of varying structure based on differences in volatility as reflected in differences in boiling points. In other refining operations, the chemical structure of the petroleum materials is altered by conventional procedures such as thermal cracking or hydroprocessing.

In a number of these physical or chemical transformations, hydrogen chloride and ammonia are present or are produced. As a result, it is not uncommon to observe formation and subsequent deposition of ammonium chloride within the processing system. Ammonium chloride is a solid with a sublimation temperature of 340° C. (644° F.) which, upon deposition during processing, can and does foul and plug processing equipment.

In distillation columns employed for physical separations of petroleum material components, when ammonium chloride is present the deposits tend to form on distillation trays, in recycle circuits and in the overheads of the distillation tower, and the resulting deposits cause substantial operating difficulties when the trays or lines become plugged. It is known to remove such deposits by chemical procedures but such methods often result in the undesirable introduction of ammonium chloride into one or more product streams, e.g., into the kerosine or gas oil products.

In operation such as hydroprocessing, the presence of ammonia and hydrogen chloride in the initial feed or the formation thereof during the hydroprocessing also leads to fouling or plugging upon ammonium chloride formation and deposition, frequently in heat exchangers. The conventional method of combatting such deposition is to introduce water at a point upstream of the location where deposition takes place. However, this procedure is not effective if the deposition occurs at a point where water cannot be provided or at a temperature and pressure at which the conventional liquid water wash cannot be applied.

It would be of advantage, therefore, to have an improved method of retarding or preventing ammonium chloride deposition, at least in portions of the petroleum material processing operations where conventional methods cannot be used.

SUMMARY OF THE INVENTION

The present invention provides an improved method for retarding the deposition of ammonium chloride during processing of hydrocarbon materials such as encountered during petroleum processing. More particularly, the invention provides a method for retarding, including preventing, ammonium chloride deposition during the processing of hydrocarbon materials in processing systems where, under varying conditions of temperature and/or pressure, mixtures of hydrocarbons and other materials including ammonia and hydrogen chloride associated therewith are separated by differences in vapor pressure. The process of the invention comprises the addition of an inert gas upstream from the location at which ammonium chloride would otherwise deposit.

DESCRIPTION OF THE INVENTION

Figure 1:
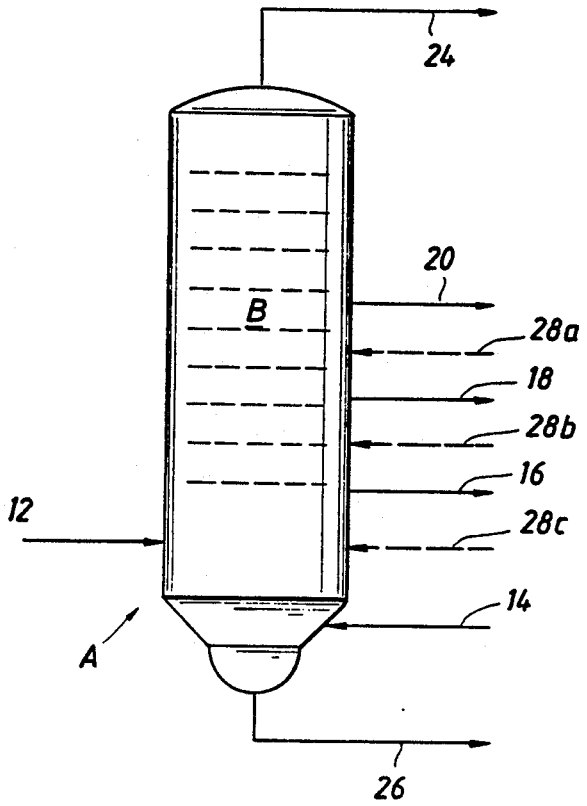
FIG. 1 depicts an otherwise conventional distillation zone, in the form of a single distillation tower, with indicated locations of where inert gas is appropriately introduced according to the invention.

In petroleum refining operations, the material processed is primarily a mixture of hydrocarbons of various chemical and physical properties. The refining operations, broadly speaking, separate the materials of desirable structure and properties for specific and contemplated uses, e.g., gasoline or jet fuel, and alter to a considerable extent the structure and properties of at least a portion the remaining hydrocarbons to provide additional material of more desirable properties. As a complicating factor, most crude oils and hydrocarbon mixtures derived therefrom initially contain various components such as sulfur compounds, nitrogen compounds and heavy metal compounds which cannot be released to the environment without special treatment because of health and safety concerns.

Physical separations are conventionally performed by one or more distillation units to which, in one embodiment, the process of the invention is suitably applied. Within such a unit, which may be one but may be more distillation towers, the operating conditions are controlled such that the temperature decreases during passage through the unit. As an alternative to or in combination with the decrease in temperature, the operating pressure is also decreased during passage through the unit. The unit is designed to remove the more volatile components, i.e., the components of higher vapor pressure and lower boiling point, as an overhead product or product mixture and to reject the less volatile or higher boiling components at a point or points upstream from removal of overhead product. The least volatile materials are suitably removed as bottoms products or product mixture and it is within the skill of the art to perform multiple separations as by withdrawing one or more side streams from the unit thereby obtain products of an intermediate volatility or of a boiling point between that of the overhead product and that of the bottoms product.

If a mixture of petroleum materials undergoing distillative separation contains ammonia and hydrogen.chloride, or if such inorganic materials are formed by chemical transformations during distillation, the formation and deposition of ammonium chloride during distillation is possible. The formation of ammonium chloride is governed by an equilibrium with its decomposition and is measured by an equilibrium constant. At any given temperature the equilibrium constant for ammonium chloride formation is determined by the partial pressures of the ammonia and hydrogen chloride present in an equilibrium mixture within the gaseous portion of the distillation mixture. If the product of the partial pressure of ammonia and the partial pressure of hydrogen chloride exceeds the equilibrium constant at that temperature, ammonium chloride will form and likely deposit. If the product of the partial pressures is lower than the equilibrium constant, ammonium chloride is not stable and will not form to any considerable extent. Without wishing to be bound by any particular theory, the process of the invention effectively lowers the partial pressures of ammonia and hydrogen chloride by supplying additional inert gas to a point upstream of where ammonium chloride would deposit. With additional gas present the total pressure is raised but the partial pressures of ammonia and hydrogen chloride are lowered so that the product of the partial pressures of ammonia and hydrogen chloride does not exceed the equilibrium constant and the deposition of ammonium chloride is retarded or does not occur.

A variety of conventional methods are available for altering the structure and properties of petroleum materials. One such process, by way of illustration, is broadly termed "hydroprocessing". In such a process the hydrocarbon materials are contacted with molecular hydrogen under a variety of conditions of temperature and pressure and usually in the presence of a catalyst. The hydroprocessing operations serve a variety of purposes. Unsaturated hydrocarbons present in the feed, e.g., olefins, acetylenes or aromatics, are at least partially hydrogenated. Non-hydrocarbon components of the feed such as compounds containing nitrogen, sulfur or heavy metals are also processed to facilitate removal of the nitrogen, sulfur or metal before the hydroprocessed material is passed to other processing operations. The hydroprocessing also typically serves to crack heavier portion of the feed to materials of lower molecular weight and higher volatility.

At the conclusion of the hydroprocessing operation, the hydroprocessed product comprises a complex mixture of hydrocarbons of varying molecular weight and various inorganic materials such as unreacted hydrogen, hydrogen sulfide, hydrogen chloride and ammonia which must then be separated. In a second embodiment, the process of the invention is usefully employed in this separation. The separation generally takes places in a number of flashing and distillation zones in which temperature and pressure vary. Typically, the initial separation is in a high pressure, high temperature separator where the inorganic products and light cracked hydrocarbons are separated from the higher boiling materials. It is in the separation portions of the process scheme where ammonium chloride deposition is likely to be encountered, as well as in the heat exchangers downstream from the hydroprocessing reactor but upstream of the separation units.

The determination of whether or not ammonium chloride will form and deposit within the separation of hydroprocessing products is on the same basis as that described above with reference to the distillation unit embodiment. If the product of the partial pressure of ammonia and the partial pressure of hydrogen chloride exceeds the equilibrium constant for formation of ammonium chloride at the relevant temperature, formation of ammonium chloride will occur and subsequent deposition of ammonium chloride is likely. In this hydroprocessing embodiment as well as the distillation embodiment, the deposition of ammonium chloride is retarded or prevented by lowering the partial pressures of ammonia and hydrogen chloride. This partial pressure lowering, accordingly to the invention, is achieved by introducing inert gas at a point upstream from the location where ammonium chloride deposition would otherwise occur. Sufficient inert gas is introduced to raise the total pressure to a value at which the product of the partial pressures of ammonia and hydrogen chloride do not exceed the relevant equilibrium constant.

In any embodiment, the inert gas useful in lowering ammonia and hydrogen chloride partial pressures through overall pressure increase is suitably a gas which is inert towards the components of the product mixture being separated and which has a vapor pressure above that of ammonium chloride at the temperature of the separation. The inert gas, in one modification, is an inorganic gas such as hydrogen, helium, nitrogen, or argon. If the separation process involves steam for heating purposes, an excess of steam usefully serves as inert gas. In the preferred modification, however, the inert gas is an organic gas which is usefully a natural gas, ethane or propane but more preferably is a hydrocarbon product of the processing operation which has been removed from the feed mixture at a point downstream from that at which the ammonium chloride would otherwise deposit and which is then reintroduced at a point upstream from where the deposition would otherwise occur. This recycled gas, depending upon the particular separation taking place, is suitably a heavy gas oil, a light gas oil, a naphtha or other hydrocarbon fraction. The precise chemical nature of the inert gas introduced is not material, so long as it is inert, as the process of the invention is based on the physical properties and not on the chemical nature of the materials present. In either described embodiment, the withdrawal and reintroduction of gaseous material as by recycle serves to increase the overall operating pressure, lower the partial pressures of hydrogen chloride and ammonia and retard or prevent ammonium chloride deposition.

It should be recognized that it is not necessary for the process of the invention to retard or prevent the formation and deposition of ammonium chloride throughout the processing operation as a whole. In a typical overall hydroprocessing scheme, for example, there are portions of the processing where ammonia and hydrogen chloride can be and are removed so that the deposition of ammonium chloride is no longer a problem. In one such scheme, there are one or more locations where a portion of the hydroprocessed product undergoes a water wash either before or after various separation steps. This treatment, among other purposes, serves to remove the ammonium chloride precursors. However, the process of the invention effectively serves to "move" the hydrogen chloride and ammonia downstream during the processing, without ammonium chloride deposition, to a point where the normal processing or conventional ammonium chloride technology is effective to avoid the problem of equipment plugging because of ammonium chloride deposition.

DETAILED DESCRIPTION OF DRAWINGS

The invention is further illustrated by reference to FIGS. 1 and 2 which depict embodiments of the invention.

FIG. 1 describes the embodiment in which hydrocarbon fractions are separated in a multi-tray distillation unit shown for illustration as a single distillation tower A. In this embodiment, crude oil feed enters the tower A by line 12 and steam is provided by line 14. The temperature within such a tower varies from about 370° C. (700° F.) at the bottom to about 120° C. (250° F.) at the top. The operating pressure is from about 10 psig to about 30 psig. The illustrative products of the distillative separation are heavy gas oil removed by line 16, light gas oil or middle distillate removed by line 18, and heavy naphtha is removed at line 20. Light naphtha and non-condensing gas are obtained as an overhead product and passed by line 24 for further processing (not shown). Resid and heavy crude oil fractions are removed as bottoms product by line 26 and also sent for further processing (not shown). Depending upon the particular operating pressure at various locations within the tower and the proportions of hydrogen chloride and ammonia present at that location, ammonium chloride can deposit on one or more distillation trays within the tower. The process of the invention comprises the addition of inert gas upstream (lower in the tower) from the point of deposition to increase the total overall pressure, thereby lowering the partial pressures of hydrogen chloride and ammonia and retard or prevent ammonium chloride deposition.

Choosing for illustration purposes the distillation tray B where under the conditions of operation ammonium chloride would normally deposit, such deposition is retarded or prevented by providing inert gas upstream of tray B, for example, by providing inert gas by at least one of the lines 28*a*, 28*b*, or 28*c* which are alternate locations where inert gas is illustratively introduced. If the inert gas is obtained externally, introduction is useful by any of the 28*a–c* lines. If the inert gas is a hydrocarbon fraction removed from the processing and reintroduced, the use of heavy naphtha would be suitable as it is removed from the tower A downstream from the point of ammonium chloride deposition, by line 20. The heavy naphtha is then suitably introduced by any of 28*a–c*. Removal and reintroduction of light gas oil or middle distillate or heavy gas oil would not be suitable as those hydrocarbon products are removed upstream from the point of ammonium chloride deposition.

Figure 2:
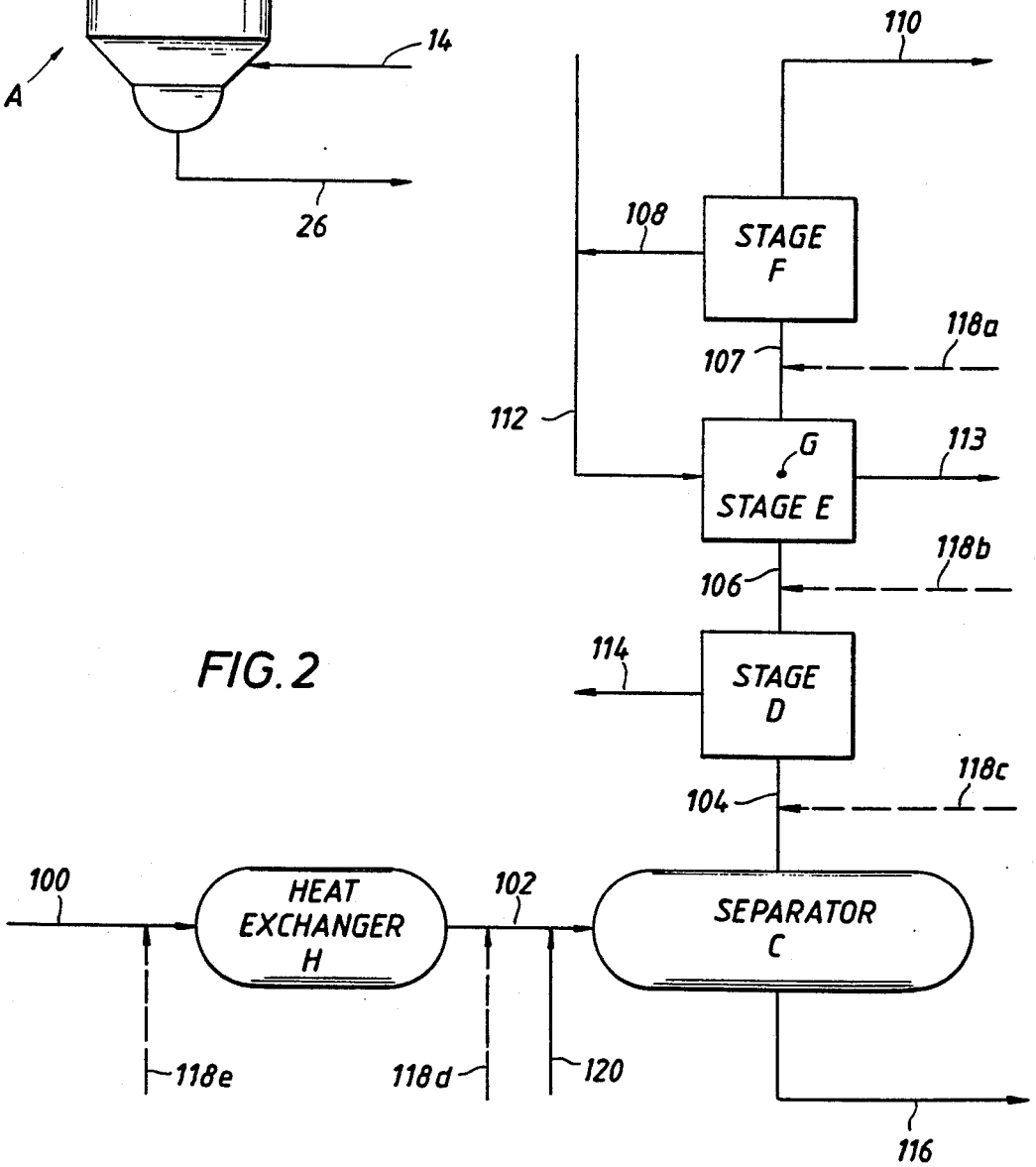
FIG. 2 depicts a portion of an otherwise conventional hydroprocessing system, with indicated locations of where inert gas is appropriately introduced according to the invention.

FIG. 2 depicts, as a second embodiment, a portion of a hydroprocessing unit downstream from a catalytic reactor (not shown) in which a hydrocarbon feed is contacted with molecular hydrogen in the presence of a catalyst. The hydroprocessed product then undergoes further processing including the separations of the portion of the overall scheme shown in FIG. 2. The process of the invention is suitably applied to the portion of the overall processing scheme shown, but application of the invention to hydroprocessing broadly is not necessarily so limited.

Hydrocarbon feed of varying composition containing non-hydrocarbon components is fed by line 102 to a high pressure, high temperature separator C wherein unreacted hydrogen, hydrogen sulfide, ammonia, hydrogen chloride, hydrocraked light hydrocarbons such as naphtha and kerosine, and any other light products are taken overhead by line 104 to stage D wherein the heavier portion of the light hydrocarbons is removed by line 114 and returned to the hydroprocessing reactor (not shown). A stage as used herein indicates one of the conventional separation systems. The remaining light hydrocarbons and the low-boiling inorganic components pass by line 106 to stage E where make-up hydrogen is provided by line 112 and hydrocarbon and hydrogen are removed by line 113 for return to the hydroprocessing reactor (not shown). The remaining inorganic materials are light hydrocarbons conveyed by line 107 to stage F, from which hydrogen is removed by line 108 and added to the make-up hydrogen of line 112. The overhead from stage F is sent by line 110 to a water wash (not shown) where water soluble inorganic materials are removed and then sent to a high pressure, low temperature separator (not shown). The unflashed bottoms product of the high pressure, high temperature separator C is removed by line 116 and sent to a low pressure, high temperature separator (also not shown) where additional hydroprocessed materials are separated. The hydrocarbon hydroprocessing reactor effluent, prior to entering separator C, passes from the hydroprocessing reactor (not shown) by line 100 to heat exchanger H and then by line 102 as hydrocarbon feed to separator C. Line 120 provides, when applicable, liquid water optionally employed as a conventional water wash utilized in such separation systems. Under the conditions of temperature and pressure employed, the water remains substantially as liquid water and is not effective in removing or retarding ammonium chloride deposits. The water, when used, enters separator C and exits the separator C with liquid materials by line 116.

The lines 118*a–e* represent alternate illustrative points of introduction of inert gas to retard or prevent ammonium chloride deposition in the part of the processing scheme shown. By way of illustration, if the retardation or prevention of ammonium chloride at point G in stage E is to be accomplished, inert gas is suitably introduced at one or more of lines 118*b–e*. The inert gas is externally obtained as indicated above or is a recycle stream. The streams withdrawn by lines 107, 108 or 110 are suitable for reintroduction in at least one of 118*b–e* as inert gas as these streams are withdrawn downstream from point G. The hydrocarbon fraction removed from stage D by line 114 is not suitable as this material is removed upstream from the point of ammonium chloride deposition.

It should be understood that the above descriptions of embodiments of the invention are for purposes of illustration only and should not be regarded as limiting the invention. The process, although described in terms of petroleum processes, is broadly applicable to petrochemical and other processes wherein ammonia and hydrogen chloride combine to create fouling and plugging problems.

What is claimed is:

1. In the processing of petroleum materials wherein mixtures of hydrocarbons and other materials including hydrogen chloride and ammonia normally encountered in such processing are separated by vapor pressure differences in a system for the processing in which at least one of temperature and pressure is varied, the improvement of retarding ammonium chloride deposition in the processing system which comprises introducing inert gas into the processing system in at least one point upstream from where ammonium chloride would otherwise deposit.

2. The process of claim 1 wherein the inert gas has a vapor pressure above that of ammonium chloride at the temperature of the separation.

3. The process of claim 2 wherein the inert gas is an inorganic gas.

4. The process of claim 3 wherein the inorganic gas is steam.

5. The process of claim 3 wherein the inorganic gas is nitrogen.

6. The process of claim 2 wherein the inert gas is an organic gas.

7. The process of claim 6 wherein the inert gas is a material withdrawn from the processing system at a point downstream from the point at which ammonium chloride would deposit.

8. In the process for separating hydrocarbons from other materials normally associated therewith during the process of petroleum refining, including hydrogen chloride and ammonia by vapor pressure differences in a distillation system where at least one of temperature and pressure is varied, the improvement of retarding the deposition of ammonium chloride in the distillation system which comprises introducing inert gas having a vapor pressure higher than that of ammonium chloride at the temperature of separation into the distillation system at a point upstream from where ammonium chloride would otherwise deposit.

9. The process of claim 8 wherein the inert gas is steam.

10. The process of claim 8 wherein the inert gas is a separation product removed from the distillation system at a point downstream from the point at which ammonium chloride would otherwise deposit.

11. In the process for recovering hydrocarbons from a mixture thereof with hydrogen chloride and ammonia by vapor pressure differences in a separation system in which at least one of temperature and pressure is varied, the improvement of retarding the deposition of ammonium chloride in the separation system which comprises introducing an inert gas of vapor pressure higher than ammonium chloride at the temperature of separation at a point in the system upstream of where the ammonium chloride deposition would otherwise occur.

12. The process of claim 11 wherein the inert gas is hydrocarbon removed from the separation system at a point downstream from where ammonium chloride would otherwise occur.

13. In the refining separation of crude oil containing a mixture of hydrocarbons and other materials, including hydrogen chloride and ammonia normally associated therewith in the refining procedure, by vapor pressure differences in a separation system wherein at least one of temperature and pressure is varied, the improvement of retarding ammonium chloride deposition which comprises introducing an inert gas into the separation system at a point upstream from where ammonium chloride deposition would otherwise occur.

14. The process of claim 13 wherein the inert gas is an inorganic gas.

15. The process of claim 14 wherein the inorganic gas is steam.

16. The process of claim 14 wherein the inorganic gas is nitrogen.

17. The process of claim 13 wherein the inert gas is an organic gas.

18. The process of claim 17 wherein the organic gas is a natural gas.

19. The process of claim 17 wherein the organic gas is hydrocarbon removed from the separation system at a point downstream from where ammonium chloride would otherwise deposit.

* * * * *